US009296548B2

(12) United States Patent
Schekalla

(10) Patent No.: US 9,296,548 B2
(45) Date of Patent: Mar. 29, 2016

(54) UTILITY-BLADE DISPENSER

(75) Inventor: Peter Schekalla, Wuppertal (DE)

(73) Assignee: MARTOR KG, Solingen (DE)

( * ) Notice: Subject to any disclaimer, the term of this patent is extended or adjusted under 35 U.S.C. 154(b) by 0 days.

(21) Appl. No.: 12/893,377

(22) Filed: Sep. 29, 2010

(65) Prior Publication Data

US 2011/0233229 A1 Sep. 29, 2011

(30) Foreign Application Priority Data

Sep. 29, 2009 (DE) ..... 10 2009 043 373

(51) Int. Cl.
*B65D 83/10* (2006.01)
*B65D 83/08* (2006.01)

(52) U.S. Cl.
CPC ..... *B65D 83/10* (2013.01); *B65D 83/087* (2013.01); *B65D 83/0829* (2013.01); *B65D 2583/082* (2013.01)

(58) Field of Classification Search
USPC ..... 221/64, 65, 197, 208, 246, 251, 268, 221/270
See application file for complete search history.

(56) References Cited

U.S. PATENT DOCUMENTS

| | | | | | |
|---|---|---|---|---|---|
| 1,378,294 | A | * | 5/1921 | Stevenson | 221/246 |
| 1,756,439 | A | * | 4/1930 | Schick | 30/536 |
| 2,326,202 | A | | 8/1943 | Bryan | |
| 2,613,806 | A | * | 10/1952 | Nicholas | 221/36 |
| 2,701,722 | A | * | 2/1955 | Bone | 276/45 |
| 2,775,366 | A | | 12/1956 | Wilhelm | |
| 2,863,586 | A | * | 12/1958 | Testi | 221/102 |
| 2,899,105 | A | * | 8/1959 | Testi | 221/309 |
| 3,061,146 | A | * | 10/1962 | Nyerges et al. | 221/246 |
| 3,563,412 | A | * | 2/1971 | James | 221/224 |
| 3,779,423 | A | * | 12/1973 | Quinn et al. | 221/186 |
| 3,833,146 | A | * | 9/1974 | Braginetz | 221/66 |
| 4,379,514 | A | * | 4/1983 | Joffe | 221/279 |
| 4,509,656 | A | * | 4/1985 | Rosler | 220/8 |
| 4,826,042 | A | | 5/1989 | Vujovich | |
| 4,872,593 | A | * | 10/1989 | Behringer | 221/231 |
| 6,121,544 | A | * | 9/2000 | Petsinger | 174/353 |
| 6,953,131 | B2 | * | 10/2005 | Devine | 221/246 |
| 7,308,771 | B2 | * | 12/2007 | Memelink | 40/649 |

(Continued)

FOREIGN PATENT DOCUMENTS

| | | | |
|---|---|---|---|
| DE | 8530894 | U | 4/1987 |
| DE | 29605063 | U | 7/1996 |

(Continued)

*Primary Examiner* — Gene Crawford
*Assistant Examiner* — Kelvin L Randall, Jr.
(74) *Attorney, Agent, or Firm* — Andrew Wilford

(57) ABSTRACT

A dispenser for utility-knife blades has a longitudinally elongated housing having a longitudinally forwardly open front end and a pair of transversely confronting inner faces each formed with a flat front portion terminating at the open front end and a flat rear portion. Each front portion is offset transversely outward from the respective rear portion and forms therewith a respective longitudinally forwardly directed shoulder. A slide in the housing is formed with a transversely throughgoing compartment adapted to hold a stack of the utility knife blades. The slide is shiftable between a rear position with the stack of blades resting by gravity on the rear portion of whichever inner face is directed upward and a front position with the stack resting on the front portion of the upwardly directed inner face and forward of the shoulder of the upwardly directed inner face. The offset is equal generally to a thickness of a single blade.

8 Claims, 8 Drawing Sheets

(56) References Cited

U.S. PATENT DOCUMENTS

| | | | | |
|---|---|---|---|---|
| 7,337,918 | B2 * | 3/2008 | Fowler et al. | 221/65 |
| 7,857,022 | B2 * | 12/2010 | Kraml | 150/149 |
| 9,033,184 | B2 * | 5/2015 | Walter | 221/102 |
| 2002/0162849 | A1 * | 11/2002 | Chen | 221/65 |
| 2003/0085236 | A1 * | 5/2003 | Schmidt | 221/232 |
| 2006/0118570 | A1 * | 6/2006 | Fowler et al. | 221/65 |
| 2007/0284277 | A1 * | 12/2007 | Gnepper | 206/528 |
| 2008/0217353 | A1 * | 9/2008 | Newman et al. | 221/210 |
| 2009/0194557 | A1 * | 8/2009 | Van Deursen | 221/232 |
| 2011/0278321 | A1 * | 11/2011 | Chan et al. | 221/198 |

FOREIGN PATENT DOCUMENTS

| | | | |
|---|---|---|---|
| DE | 102005019650 | B | 11/2006 |
| DE | 202009010256 | U | 11/2009 |
| NL | 68821 | C | 10/1951 |

* cited by examiner

UTILITY-BLADE DISPENSER

FIELD OF THE INVENTION

The present invention relates to a blade dispenser. More particularly this invention concerns such a dispenser for utility-knife blades.

BACKGROUND OF THE INVENTION

Such a blade dispenser is well known. In it, a plurality of blades are held in a plastic housing. The blades are pressed by a spring against a housing wall. The housing wall has a window through which a user can engage and displace a blade with the finger so that an end of the blade projects out of the housing. The blade can then be grasped and withdrawn from the housing. The lateral opening is dimensioned in such a manner that each time only one blade can be slid out of the housing.

From US 2002/0162849, a blade dispenser is known in which blades are arranged in a drawer-like case. The blades in the case are pressed by springs against an upper housing wall. The case is smaller than the housing so that it can be moved further into the housing against the force of a spring. The uppermost blade is prevented from moving by a stop attached to the upper housing wall and remains in the front position on rearward shifting of the case. From this position, the blade can be taken.

The disadvantage of this blade dispenser is that removal of the blade is difficult because during its removal of the blade, the receiving case must be retained in the rear position against the force of a spring element. In addition, the device is in need of improvement with respect to safety.

Further dispensers are known that are of relatively complex construction, typically requiring the use of springs and the like to hold everything in place and make them work. Thus, once the blades are all used, a relatively complex and possibly expensive piece of equipment must be disposed of.

OBJECTS OF THE INVENTION

It is therefore an object of the present invention to provide an improved utility-blade dispenser.

Another object is the provision of such an improved utility-blade dispenser that overcomes the above-given disadvantages, in particular that is which is of particularly simple construction, yet very safe and easy to use.

Another object is to make such a dispenser that can be made cheaply, for instance by injection molding, of as few as two parts.

SUMMARY OF THE INVENTION

A dispenser for utility-knife blades has according to the invention a longitudinally elongated housing having a longitudinally forwardly open front end and a pair of transversely confronting inner faces each formed with a flat front portion terminating at the open front end and a flat rear portion. Each front portion is offset transversely outward from the respective rear portion and forms therewith a respective longitudinally forwardly directed shoulder. A slide in the housing is formed with a transversely throughgoing compartment adapted to hold a stack of the utility knife blades. The slide is shiftable between a rear position with the stack of blades resting by gravity on the rear portion of whichever inner face is directed upward and a front position with the stack resting on the front portion of the upwardly directed inner face and forward of the shoulder of the upwardly directed inner face. The offset is equal generally to a thickness of a single blade such that displacement of the slide from the front position to the rear position causes the shoulder of the upwardly directed inner face to block rearward movement of only the lowermost blade in the stack and hold it in a forward position partly exposed at the front end of the housing.

Furthermore according to the invention movement of the slide from a rear position into a front position, shifts a blade from a holding compartment from a storage position into a removal position. In the removal position, for example the blade is arranged in the removal seat in such a manner that cutting edges of the blade are inaccessible. In the removal position of the blade, the slide is held relatively stable relative to the housing. In particular, the slide can be locked in the housing in the removal position of the blade.

Thus with this system all the user needs to do dispense a single blade is shift the slide from the back position into the front position and then into the back position. This will leave a blade partly exposed, but with its cutting edge covered, so it can be extracted and loaded into the user's utility knife.

The compartment holds at least one blade, although preferably a plurality of blades is arranged as a blade stack. The holding compartment, for example may be refilled by separating the slide completely from the housing. The complete separation of the slide from the housing, for example is prevented by means of a separation protection and is possible, for example only by means of a tool.

A blade is present in a storage position if it is in the holding compartment. If the blade is in the removal seat and can be removed by the user, it is in a removal position.

The holding compartment is formed, for example as a frame. The frame, for example is associated with the slide. Thus blades can be moved via at least two feed paths into different removal positions on opposite faces of the housing, although always the removal position on the bottom is the one that gets the blade being dispensed. If the holding compartment is formed as a frame, the blades can be moved by the frame between the rear position and the front position. Moreover, the blades can be moved out of the frame in two directions.

Handling of the blade dispenser according to the invention thus is very simple. For the movement of the blade from the holding compartment into the removal position, no contact with the blade is necessary. When grasping and withdrawing the blade from the blade dispenser, the user cannot get injured. Each time, only one blade is moved from the storage position into the removal position.

In one configuration of the invention, safety formations are provided that cover a cutting edge of the blade in the removal position completely and inaccessible to the user. The safety formations prevents contact of the cutting edge of the blade with the user in the removal position of the blade. If there are a plurality of cutting edges, all of them are covered in the removal position in such a manner that the user cannot get injured. The cutting edge can be completely enclosed, for example by sections of the slide and/or sections of the housing. The safety formations, for example can be partially or completely associated with the slide and/or the housing. A part of the safety formations, for example can be arranged laterally of a holding compartment formed by the slide. Then, a blade can be fed, for example in the front position of the slide from the holding compartment into the removal seat. During return movement of the slide into the rear position, for example the safety formation part adjacent the holding compartment can be moved in such a manner to the blade sitting in the removal position that the cutting edge of the blade is completely inaccessible.

The blade can be moved, for example by a forward and backward movement between the rear position and the front position from the storage position into the removal position. The slide is moved, for example from the rear position into the front position. In the front position, the blade is moved, for example, due to gravity into the removal seat. The backward movement of the slide from the front position into the rear position can allow a removal of the blade. Then, the blade is in the removal position. In the front position of the slide, for example the removal of the blade from the blade dispenser can be impossible.

The safety formations comprise, for example a holder associated with the slide and/or the housing and forming at least one cover for the blade. The holder, for example can cover at least part of the cutting edge of the blade. In particular, the holder can comprise a holding element that for example is a plate. In the removal seat, the blade can be retained, for example between a housing face and a contact surface of the holding element. The housing face and the contact face cover, for example at least the cutting edge of the blade in such a manner that contact of the user with the cutting edge is impossible.

For example, at least one holding element is formed by a plate. If the blade is in the removal seat, the blade can be for example between an outer face of the plate and a face of the housing.

The blade dispenser can have at least one blocking element that prevents unintentional movement of the blade. The outer face of the holding element and/or the inner face of the housing, for example carry the blocking element. For example the blocking element can be elastically deformable and press the blade against a wall. Friction then prevents for example unintentional movement of the blade. The blocking element can be for example in the movement path of the blade and, upon overcoming a reset force, can be moved elastically out of the movement path. At least one first blocking element can prevent for example unintentional movement of the blade out of the removal compartment. At least one second blocking element can prevent for example the movement of a blade arranged in the removal seat.

The housing and/or the slide have at least one recess or cutout that allows grasping the blade in the removal position. For example in both the slide and the housing, recesses can be formed that overlap or align in the front position of the slide. If the blade is in the removal seat, it can project, for example into the recess. The blade can project into the recess, for example with a part that cannot injure the user. In particular, the section of the blade projecting into the recess, for example does not have a cutting edge.

The blade dispenser has at least one feed path via which the blade can be moved into the removal seat. For example a first feed path and a second feed path can be provided. Each feed path can have a respective removal seat. By providing two feed paths, a spring which presses the blade into the removal seat can be abandoned. For example at least in a predetermined position of the slide, for example in the front position, the blade can be held by gravity in the removal seat. If two feed paths are present, the blade dispenser can be held, for example by the user, in two different positions, and in each position a blade can be fed into whichever removal seat is on the bottom.

The feed paths each have at least a rear contact face and a front contact face. One of the contact faces can be configured, for example as slide face. The faces, for example can be configured in such a manner the friction is reduced. In this manner, movement of the blade into the removal seat can be made easier. The removal seat example can be associated with one of the contact faces. For example the front contact face can be offset to the rear contact face. The offset between the rear and the front contact face forms a stop face or shoulder. In this manner it is possible, for example during backward movement of the slide, for a blade in the removal seat to be stopped and remain in the removal seat because the stop face prevents it from moving backward, while the remaining blades in the holding compartment of the slide are moved back with the slide into the rear position.

A blade to be fed from the holding compartment into the removal position can rest, for example in the rear position against the rear contact face and in the front position against the front contact face.

The rear contact face and/or the front contact face can be formed by the housing. At least one contact face can be formed, for example by an indentation in a edge of the housing. The indentations can be, for example corrugation-like so that the blade rests against the corrugation only with a small contact area. Thus, friction between the contact face and the blade is reduced.

In the rear position, the slide is completely within the housing. In the front position, the slide protrudes, for example beyond the housing. With the slide protruding in the front position beyond the housing, the blade dispenser as a whole can still be of small size.

The blade dispenser has, for example a separation protection by means of which unintentional separating of the slide from the housing can be prevented. The separation protection is configured, for example in such a manner that movement of the slide between the rear and the front position is possible. For example the separation protection can be formed by a projection attached to the slide and engaging with a groove of the housing. A separation of the slide from the housing thus is only possible for example by means of a tool. For example, filling the holding compartment with blades may be possible only if the slide is separated from the housing. This prevents one or more blades from being removed directly from the holding compartment without the blades being fed first into the removal seat.

The blade dispenser has, for example a locking mechanism that retains the slide in at least one position. The locking mechanism can be configured, for example in such a manner that a force has to be exceeded to move the slide out of a this position. For example alternatively or additionally, the locking mechanism can be configured in such a manner that a lock has to be released to move the slide out of a predetermined position. The locking mechanism can be configured, for example as snap-in locking mechanism. If at least one predetermined position is reached, the slide snaps into place in the respective position relative to the housing. The slide can be retained in the rear position, for example by means of the locking mechanism.

The blade can be moved, for example through a forward and a subsequent backward movement of the slide relative to the housing between the rear position and the front position from the storage position into the removal position. In the rear position, for example the slide can be retained relative to the housing so that it cannot unintentionally move out of the rear position. For example when stored and also if a blade is in the removal position, the slide is in the rear stable position.

The slide has, for example at least one grip. If, for example the slide is arranged completely within the housing, the slide can be actuated through an aperture in the housing, the recess being aligned with the grip. The recess, for example can be open toward an end of the housing so that the grip can be moved beyond the housing. The slide can be engaged and actuated through the aperture in each position by the user even if the slide is completely within the housing. The slide can, for example fit to the aperture or, alternatively, extend through the aperture.

For example in the removal position of the blade, the blade is inside the housing. With the blade in the removal position within the housing, housing parts can be utilized for protecting the blade from unintentional contact. Moreover, due to this embodiment, the dispenser is very small.

The holding compartment is configured, for example in such a manner that at least one blade is held by gravity against a contact face, in particular a housing face. In a rear position of the slide, the blade is in contact, for example due to gravity, with a rear contact face. In the front position of the slide, the blade is held by gravity in contact with a front contact face. The rear and the front contact faces can be portions of inner housing faces. The front contact face is, for example a face of the removal seat of the blade. If the blade is held by gravity in contact with a contact face, spring elements which keep the blade in contact with a contact face can be abandoned. Thus the entire dispenser can comprise two pieces, not counting the blades.

According to an alternative embodiment, at least one blade is held by a spring in contact with at least one contact face, in particular a housing face. If a spring is present, the blade carrier does not have to be held in a predetermined position to feed the blade into the removal seat.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
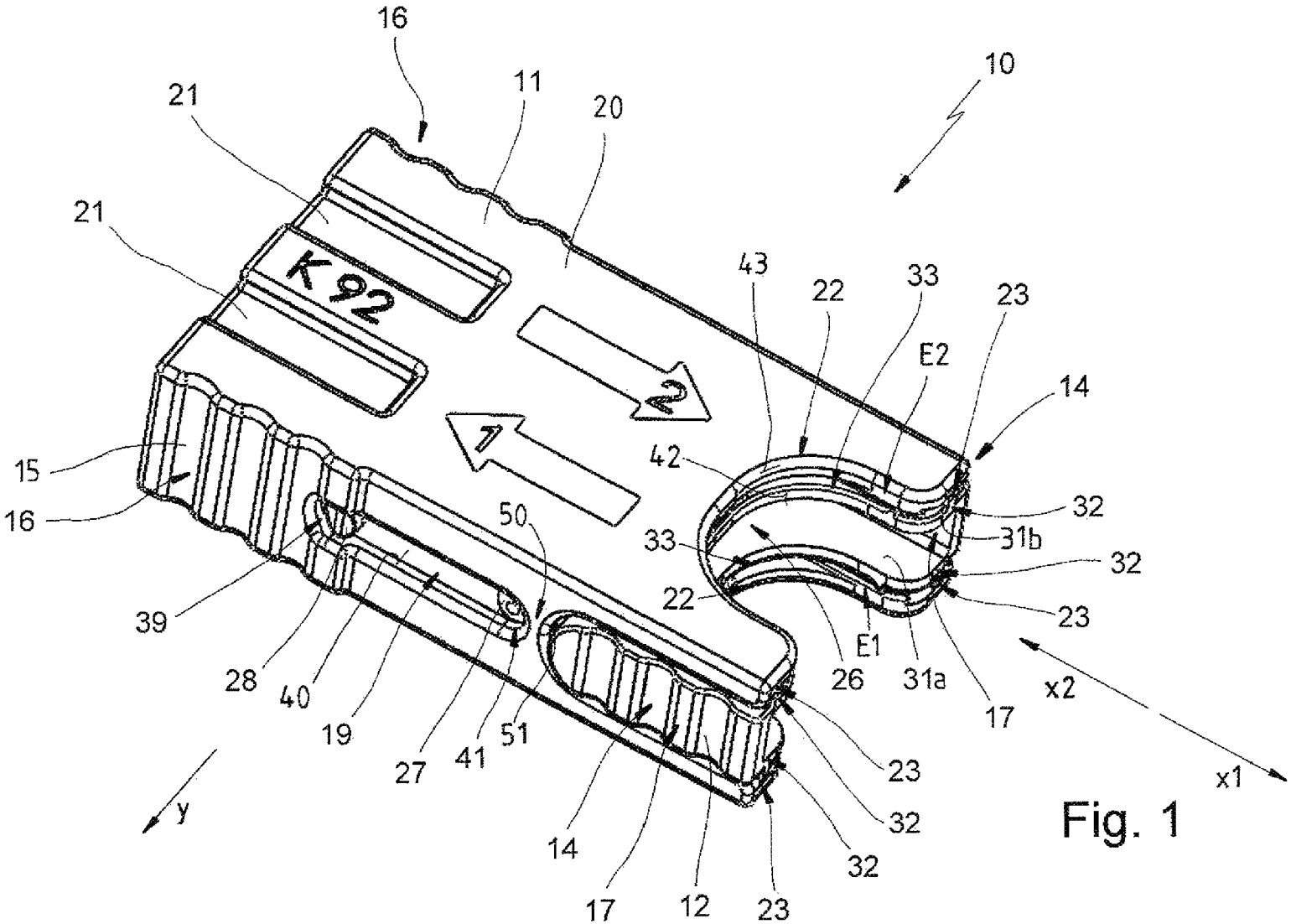
FIG. 1 is a perspective view of the blade dispenser in a rear position.
Figure 2:
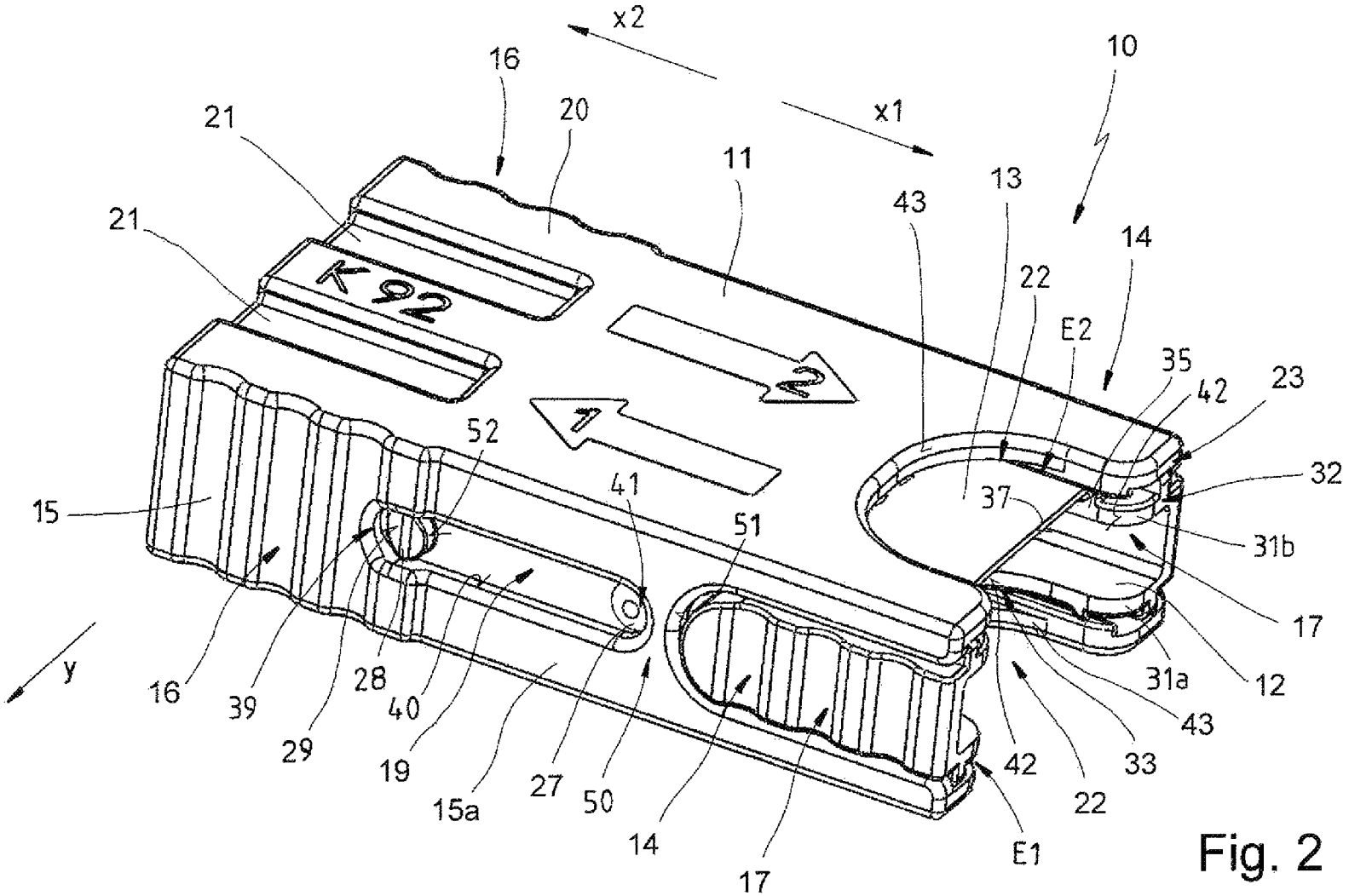
FIG. 2 is a view like FIG. 1 with a blade in the removal position.

As seen in FIG. 1 a blade dispenser 10 has a housing 11 and a slide 12. The housing 11 and the slide 12 are, for example injection molded of plastic. The slide 12 is mounted in the housing 11 for movement in a straight line. Each of the narrow sides of the slide 12 is formed with a respective grip formation 14 for actuating the slide 12. The slide 12 can be moved with respect to the housing 11 from a rear position shown in FIG. 1, in an outward direction x1 into a front position shown in FIG. 7. If the slide 12 is moved from the front position in the direction x2 back into the rear position, a single blade 13 is shifted into a removal position as shown in FIG. 2. The blade 13 is a strip steel blade.

Figure 3:
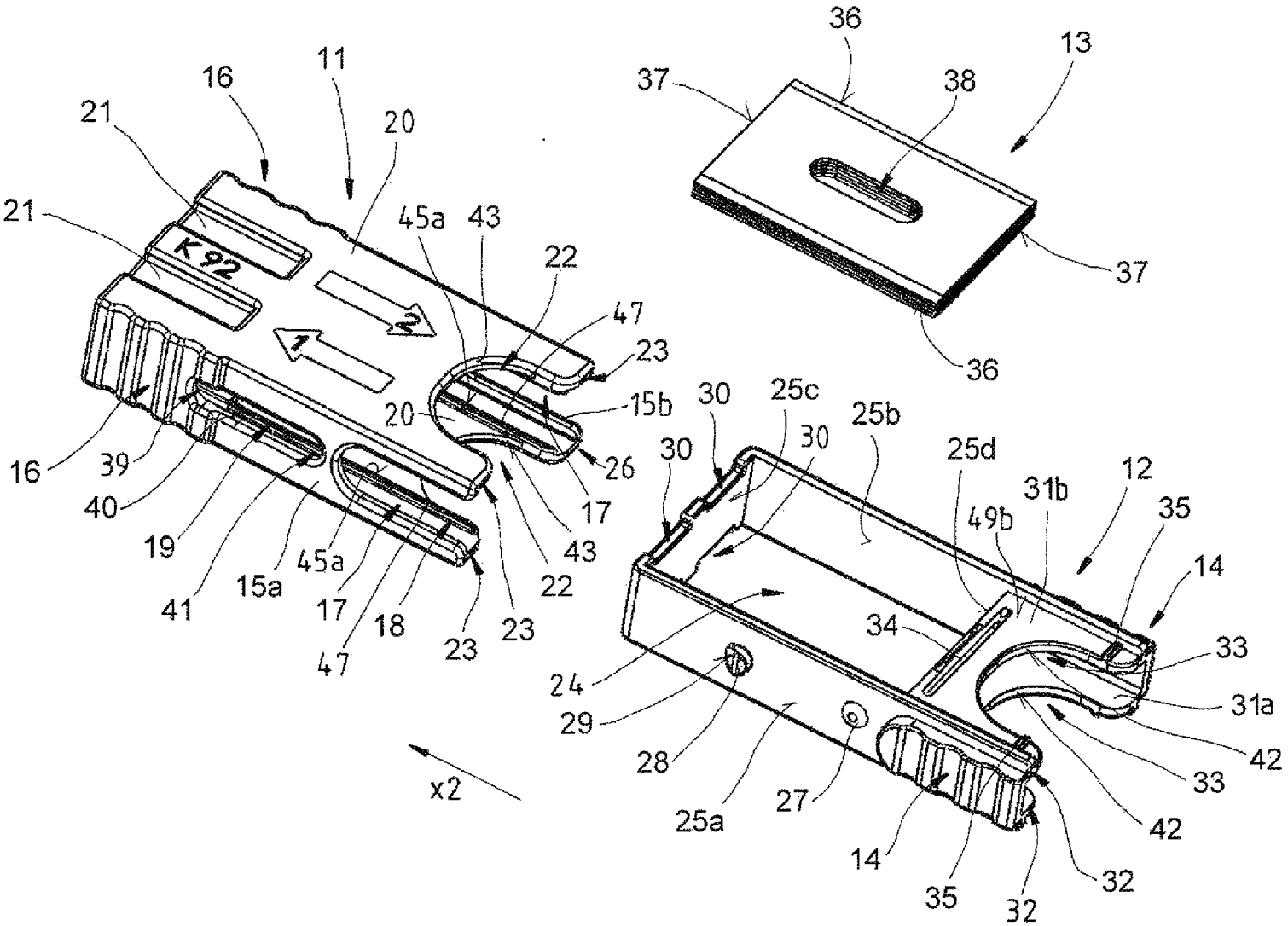
FIG. 3 is a perspective exploded view of a housing, a slide of the blade dispenser, and a plurality of blades.

FIG. 3 shows how narrow sides or edges 15*a* and 15*b* of the housing 11 are each formed with a profiled area 16. Due to the profile area 16, the housing 11 can be held safely and slipping of the hand of the user is prevented. The edges 15*a* and 15*b* have U-shaped cutouts 17 opening forwardly at a front end 18. The narrow edge 15*a* is also formed with an elongated throughgoing slot 19 whose function is described below. The wide sides or faces 20 of the housing 11 are formed with indentations 21 that serve as guides for the slide 12 and form a contact face for the blades 13 which will be explained in more detail. In addition, the faces 20 are formed with front cutouts 22 each formed with a beveled edge 43 and both open forward and merging with a front edge 23 of the respective face 20.

The slide 12 forms a parallepipedal holding compartment 24 bordered by planar walls 25*a*, 25*b*, 25*c*, and 25*d* but with no floor, so that it is basically a rectangular transversely throughgoing window. Each of the walls 25*a* and 25*b* carries a respective one of the grips 14. The wall 25*a* is formed with a part-spherical bump 27 and with a cylindrical projection 28 having an angled end face 29. The rear end wall 25*c* is formed with four shallow notches 30 that fit with the respective indented ridges 21 of the housing 11 to form a guide for the slide 12 during the movement in the housing 11 between the rear and the front positions.

The side housing walls 25*a* and 25*b* are bridged by parallel flat webs 31*a* and 31*b* each formed with a cutout 33 that opens toward a front end 32 of the slide 12 and that is basically of the same shape as the respective cutout 22. On sides 49*a* and 49*b* facing away from each other, the webs 31*a* and 31*b* are each formed with a rear rib 34 and with two aligned front ribs 35 flanking the recess 33. The webs 31*a* and 31*b* extend from the wall 25*d* and thus are adjacent the holding compartment 24.

Each blade 13 has two side cutting edges 36 and two blunt end edges 37 and is formed with a respective center slot 38. However, alternatively to the blades 13 of this illustrated embodiment, the dispenser 10 can also be used for storing differently shaped blades.

Figure 4:
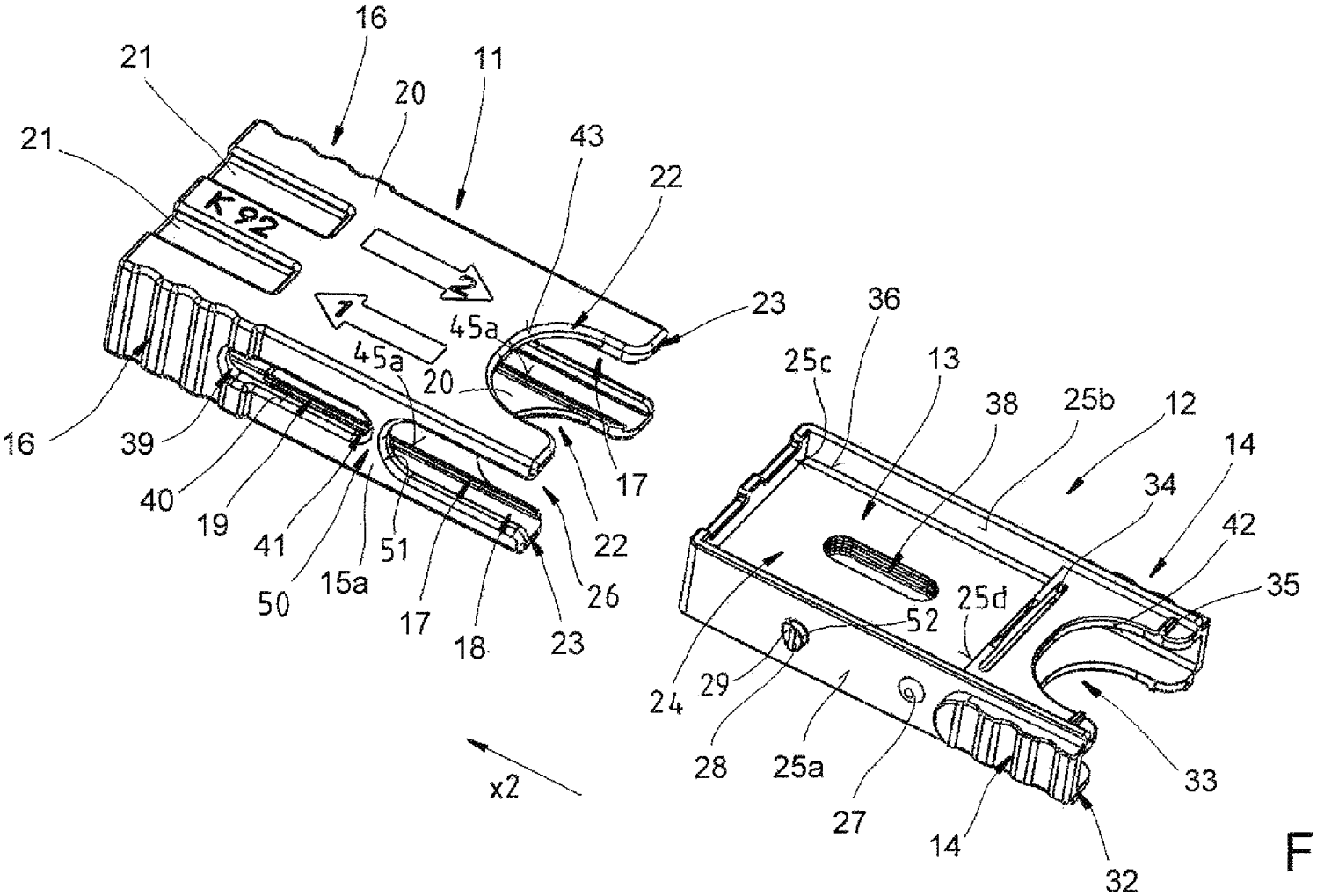
FIG. 4 is a view like FIG. 3 with the blades in a holding compartment of the slide of the blade dispenser.

According to FIG. 4, prior to installing the slide 12, a stack of blades 13 is set in the holding compartment 24 of the slide 12. Because the holding compartment 24 does not have a bottom, an assembly aid can be used for the assembly, by means of which assembly aid the blades 13 are retained in the holding compartment 24 until the slide 12 is assembled in the housing 11. Installation of the slide 12 in the housing 11 is carried out by inserting the slide 12 filled with blades 13 in the direction x2 into a front-end opening 26 (FIG. 3) of the housing 11 until the wall 25*c* of the slide 12 abuts a rear end edge 15*c* of the housing 11 (see FIG. 6).

During insertion, a bevel face 29 of the projection 28 engages an end edge 51 of the recess 17 and is cammed transversely inward opposite direction y. Once it slides past the web 50 separating the slot 19 from the cutout 17 the projection 28 moves elastically outward in the slot 19 in the direction y, locking the slide 12 in the housing 11.

During further movement of the slide 12 in the direction x2, the bump 27 also engages the edge 51. Once the elastic reset force of the edge 15*c* is overcome, the slide 12 can be further moved under elastic deformation of the edge 15*c* in the direction x2 and pass the web 50. When the wall 25*c* of the slide 12 abuts against the end 15*c* of the housing 11 and the projection 27 snaps back out into the slot 19, the slide 12 is in the rear position in relation to the housing 11.

Once the slide 12 according to FIG. 1 is completely inserted into the housing 11 and thus is in the rear position, the projection 28 is at an end 39 and the spherical projection 27 is at an opposite end 41 of the slot 19. During forward movement of the slide 12 from the rear position according to FIG. 1 in the direction x1, the projection 27 engages a beveled edge 40 of the slot 19. Further movement of the slide 12 in the direction x1 is only possible by overcoming a force for elastically outwardly deforming the narrow side wall 15*a*. In this manner, the slide 12 is retained in a stable manner in the rear position. Unintentional movement of the slide 12 from the rear position in the direction x1 is prevented.

The front position is reached when an outer side 52 of the projection 28 abuts the end 41 of the slot 19. While forces acting transverse to the moving direction x in the direction y can be transmitted via bevel face 29 from the slide 12 to the housing 11, forces in the direction y cannot be transmitted from the outer face 52 to the housing 11. Thus the outer face 52 only transmits to the housing 11 forces in the direction x1. Elastic deformation of the housing in the direction y via the outer face 52 is hence not possible.

Complete movement of the slide 12 out of the housing 11 in the direction x1 is thus not readily possible because the projection 28 cannot pass the web 50 in the direction x1. To separate the slide 12 from the housing 11, a tool is necessary. In contrast, the projection 27 can transmit forces in the direction y to the housing 11 in both directions x1 and x2 of the slide 12 because of its rounded shape. Thus, the projection 27 can pass the web 50 in both directions x1 and x2 of movement of the slide 12.

FIG. 1 shows that, in the rear position, the grip 14 of the slide 12 is in the recess 17 of the housing 11, and the recesses 33 of the slide 12 are congruent with the recesses 22 of the housing 11 so that edges 42 of the recesses 33 are adjacent edges 43 of the recesses 22. Due to the recesses 22 and 33 which are adjacent in the rear position it is readily possible, if a blade 13 is in the removal position according to FIG. 2, to grasp the blade 13 and to slide it out of the dispenser 10.

Figure 6:
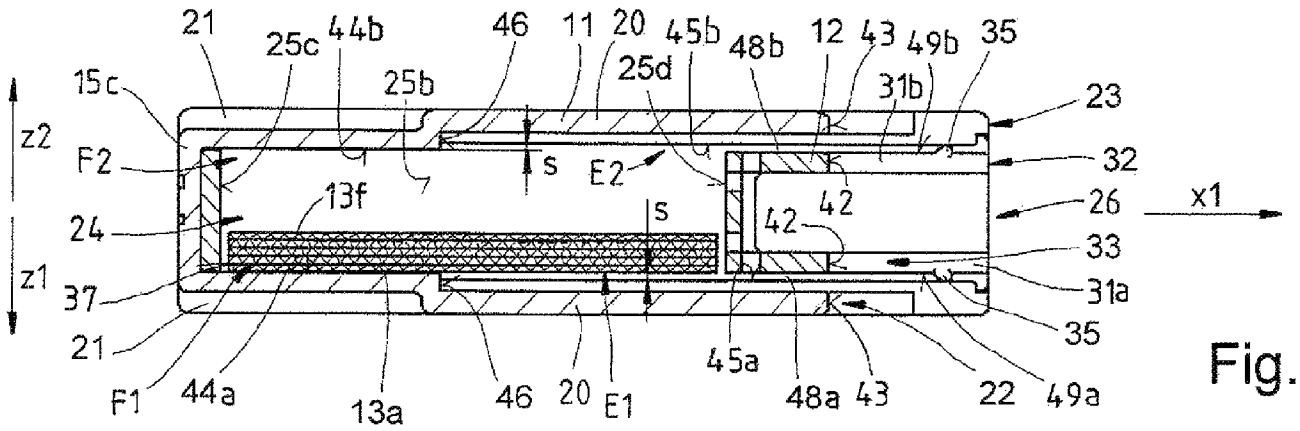
FIG. 6 is a section taken along line VI-VI of FIG. 5.

FIG. 6 shows the slide 12 in the rear position and a plurality of blades 13*a* to 13*f* in the compartment 24. Due to gravity acting in the direction z1, the lowermost blade 13*a* according to FIG. 6 rests against a lower rear inner face 44*a* of the housing 11 formed by the indentations 21.

Figure 5:
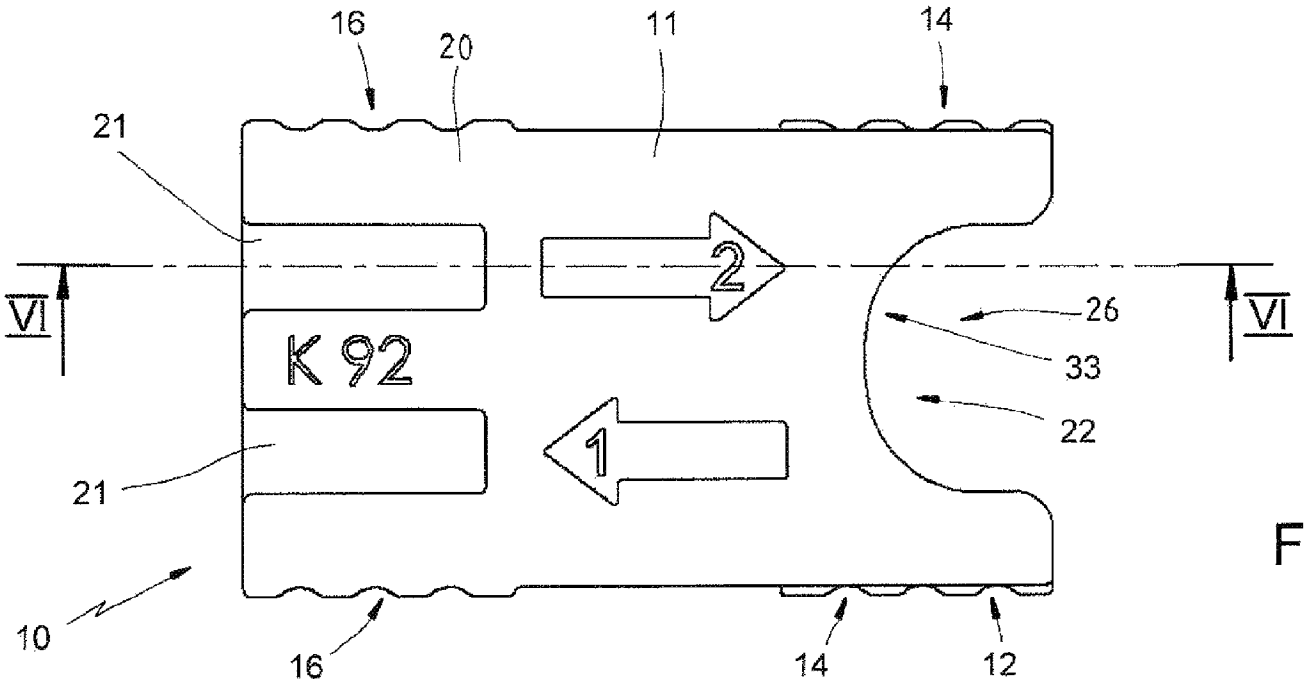
FIG. 5 is a top view of the blade dispenser with the slide in the rear position.
Figure 8:
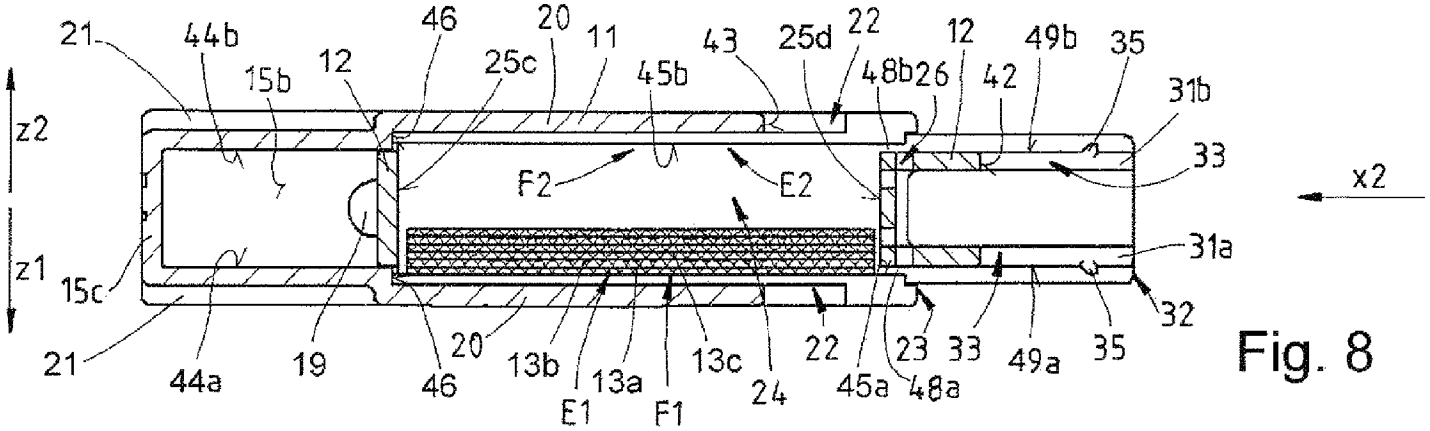
FIG. 8 is a section taken along line VIII-VIII of FIG. 7.
Figure 7:
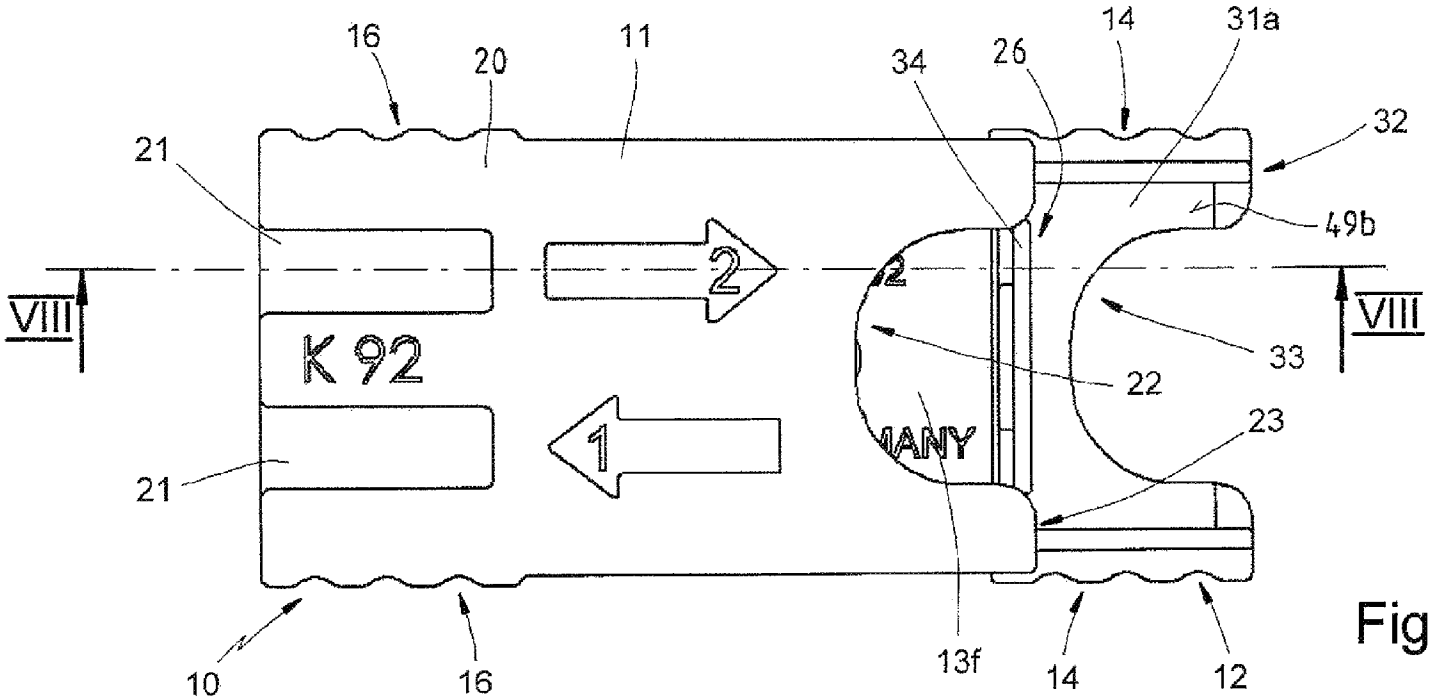
FIG. 7 is a view like FIG. 5 with the slide in a front position.

If the slide 12 is pushed forward in the housing 11 with sufficient force that the projection 27 can pass the web 50, from the rear position according to FIGS. 5 and 6 in the direction x1 into the front position according to FIGS. 7 and 8, all the blades 13*a-f* in the holding compartment 24 are also moved. In the front position, the holding compartment 24 is above a front lower inner face 45*a* of the housing 11. Due to gravity acting in the direction z1, the blade 13*a* rests against the inner face 45*a* which is formed by two ribs 47 of the housing 11 provided on each wall 20. In the front position, the front end 32 of the slide 12 projects out of the housing 11, and the blade 13*a* is inaccessible to the user and cannot be removed from the dispenser 10. The front inner face 45*a* is offset downward from the rear inner face 44*a* by an offset s. The offset s corresponds, for example to the thickness of the blade 13 or is smaller.

Between the inner face 45*a* and a surface 49*a* of the web 31*a* there is a gap 48*a*. Between the inner face 45*b* and a surface 49*b* of the web 31*b* there is another such gap 48*b*. The gaps 48*a* and 48*b* are dimensioned in such a manner that a blade 13 can fit between the inner face 45*a* and the surface 49*a* as well as between the inner face 45*b* and the surface 49*b*.

Figure 10:
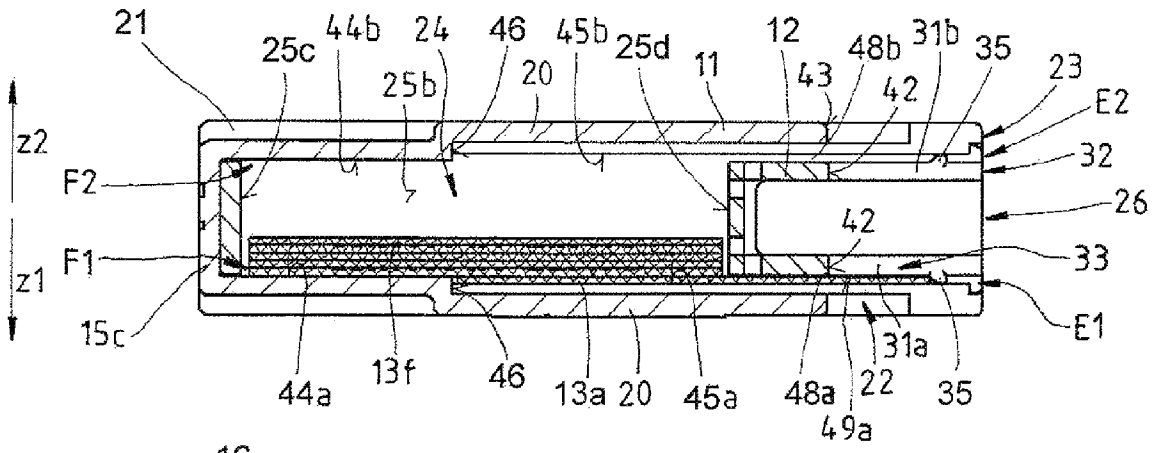
FIG. 10 is a section taken along line X-X of FIG. 9.
Figure 9:
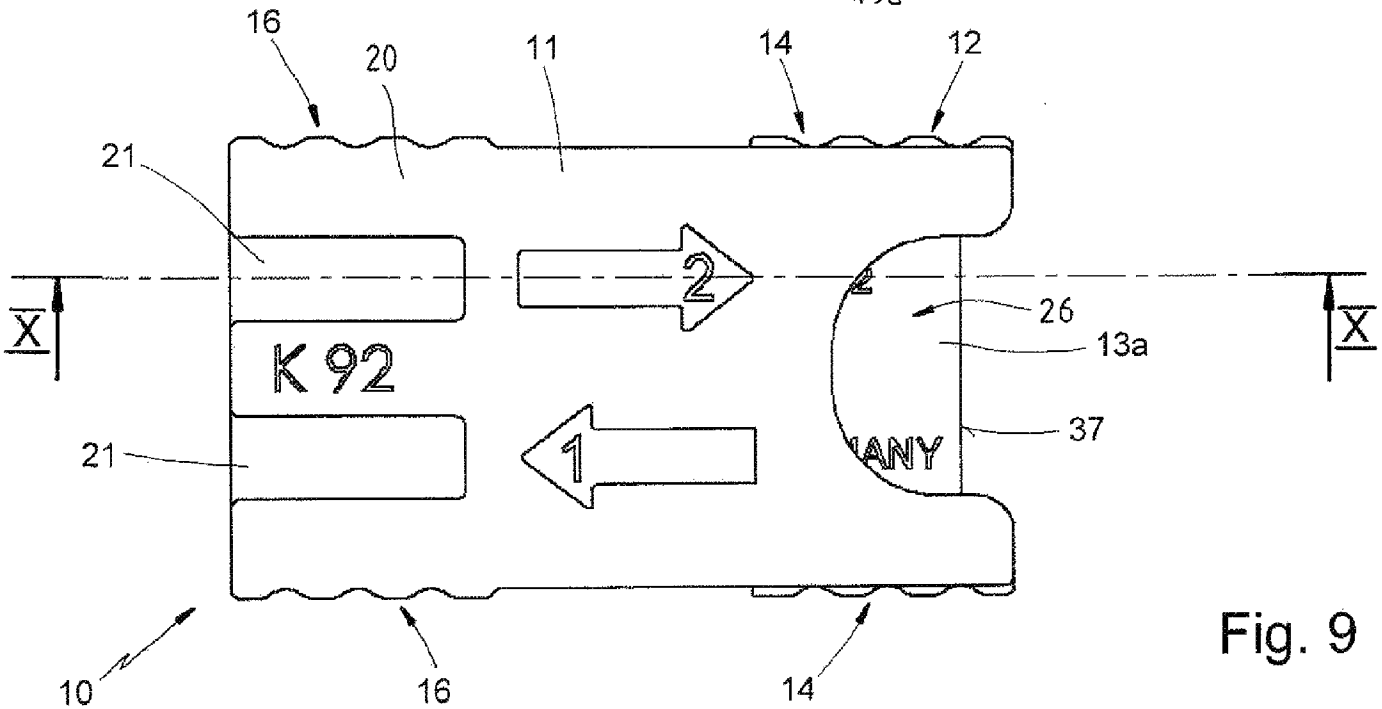
FIG. 9 is a view like FIG. 5 but with the slide in the rear position and a blade in the removal position.

During rearward movement of the slide 12 from the front position of FIGS. 7 and 8 into the rear position of FIGS. 9 and 10, the blade 13*a* is not moved back because it abuts against a perpendicular stop face or shoulder 46 formed between the inner face 44*a* and the inner face 45*a*. The remaining blades 13, however, are moved with the slide 12 back in the direction x2. During movement of the slide 12 in the direction x2 into the rear position, the wall 25*d* and the web 31*a* move across the stopped blade 13*a*.

Figure 12:
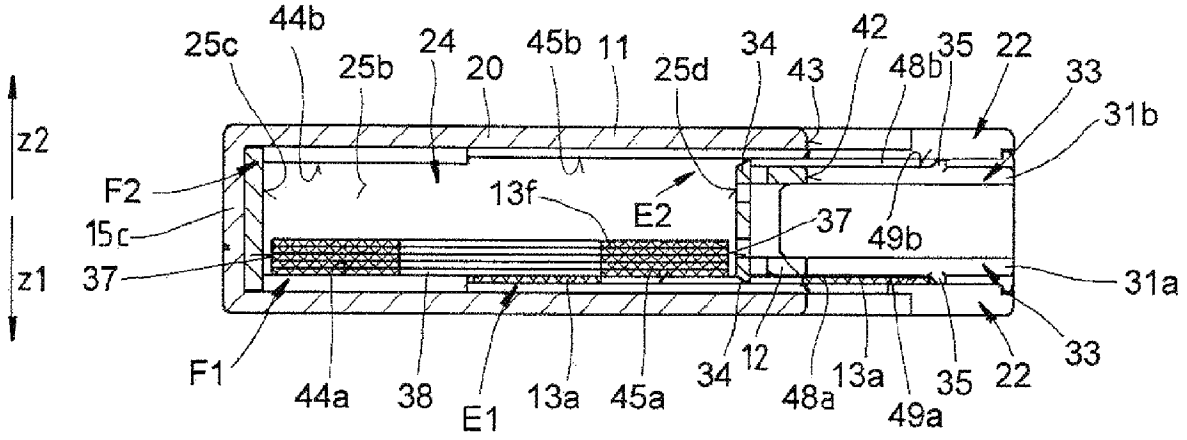
FIG. 12 is a section taken along line XII-XII of FIG. 11.
Figure 11:
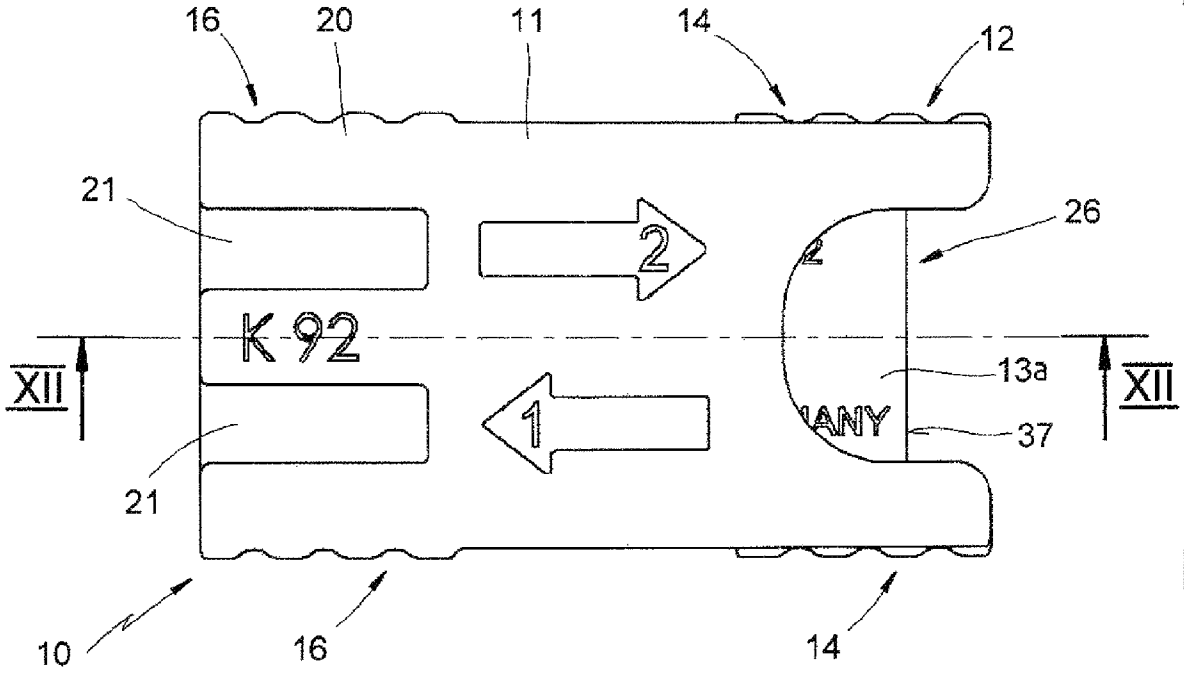
FIG. 11 is a view like FIG. 9.

According to FIGS. 9 and 10, a front-end section of the blade 13*a* is exposed in the gap 48*a* in a removal seat E1. The gap 48*a* and the gap 48*b* are laterally bordered by the edges 25*a* and 25*b*. The blade 13*a* is thus retained between the inner face 45*a*, the surface 49*a*, and the edges 25*a* and 25*b*. The rib 34 (shown for example in FIG. 12), which, if a blade 13*a* is present in the gap 48*a*, is elastically deformed during the movement of the slide 12 from the front position into the rear position, exerts an elastic retaining force on the blade 13*a*. The retaining force creates friction that prevents the blade 13*a* from slipping out of the removal seat E1 and back into the holding compartment 24. The ribs 35 are arranged in the movement path of the blade 13*a* and prevent the blade 13*a* from slipping from the removal seat E1 in the direction x1 out of the dispenser 10.

As best shown in FIG. 9, a section of the blade 13*a* projects into the recess 33 of the slide 12 and the recess 22 of the housing 11. The recesses 33 and 22 are designed in such a manner that the section of the blade 13*a* that is freely accessible cannot injure the user. The cutting edges 36 of the blade 13*a* are completely covered by the slide 12 and the housing 11, in particular by the web 31*a* and the lower wall 20 of the housing 11. Since the exposed outer edge 37 of the blade 13 is one of the blunt edges 37, the blade 13*a* can now be grasped without danger of injury and can be pulled out of the dispenser 10. To pull the blade 13*a* out of the dispenser 10, the small friction force caused by the rib 34 and a small force necessary for the elastic deformation of the ribs 35 must be overcome.

As described above the blade 13*a* was moved via a feed path F1 from the contact face 44*a* into the removal seat E1 in which the blade 13*a* rests against the inner face 45*a*. As shown in the figures, however, the slide 12 and the housing 11 are symmetrical. Thus if the gravity were effective in the direction z2, which is the case if the blade dispenser is turned upside down, then, during movement of the slide 12 from the rear position into the front position and a subsequent movement from the front position into the rear position, the blade 13*f* would be fed along a path F2 via the contact face 44*b* and the contact face 45*b* into a removal seat E2. Due to the feed paths F1 and F2, the dispenser 10 can be held in two different positions. Then, the one blade 13 fed for removal is, due to gravity, resting against the lower inner face of the housing 11.

Furthermore, in the illustrated embodiment, no spring element is necessary to press the blades 13 into a predetermined position. For this reason, production costs such as, for example material costs and assembly costs are saved.

I claim:

1. A dispenser for utility-knife blades each having at least one cutting edge, the dispenser comprising:

a housing formed with a front end having an opening and with a rear end, the housing having a first and second confronting inner faces each formed with a respective shoulder, the first inner face forming a first removal seat and the second inner face forming a second removal seat; and a slide formed with a compartment adapted to hold a stack of the utility knife blades and shiftable in the housing between a rear position and a front position, the slide having openings allowing the stack to move to the first inner face or to the second inner face, the shoulder having a height equal generally to a thickness of a single blade such that displacement of the slide from the front position to the rear position causes the shoulder to block rearward movement of only the outermost blade in the stack and hold it in a removal position in the first removal seat or the second removal seat for removal of the blade through the opening at the front end of the housing.

2. The blade dispenser defined in claim 1 wherein the inner faces are substantially symmetrical to each other relative to a longitudinally extending plane midway between them.

3. The blade dispenser defined in claim 2 wherein the front end of the housing is formed in each front portion with a forwardly open cutout in which the outermost blade is exposed in the front position of the slide.

4. The blade dispenser defined in claim 3 wherein the blades each have at least one longitudinally extending sharp cutting edge, the housing covering the cutting edge of the outermost blade in the front position of the slide.

5. The blade dispenser defined in claim 2 wherein in the rear position the slide is wholly inside the housing.

6. The blade dispenser defined in claim 2 wherein the housing is formed with a longitudinal slot, the slide being formed with an outwardly extending projection engaged in the slot and positioned at a closed front end of the slot in the front position and in a rear end of the slot in the rear position.

7. The blade dispenser defined in claim 6 wherein the projection has an angled end face, whereby the slide can be pushed into the front end of the housing with elastic deformation of the housing until the projection engages in the slot.

8. The blade dispenser defined in claim 2, further comprising a formation forward of the compartment and bearing elastically transversely on the blade in the removal position.

* * * * *